US009027752B2

(12) United States Patent
Carroll, Jr.

(10) Patent No.: US 9,027,752 B2
(45) Date of Patent: May 12, 2015

(54) SUSPENSION PACKAGING SYSTEM AND METHOD

(76) Inventor: Arch W. Carroll, Jr., Marion, IN (US)

( * ) Notice: Subject to any disclaimer, the term of this patent is extended or adjusted under 35 U.S.C. 154(b) by 0 days.

(21) Appl. No.: 12/117,376

(22) Filed: May 8, 2008

(65) Prior Publication Data

US 2008/0237088 A1 Oct. 2, 2008
US 2011/0108453 A2 May 12, 2011

Related U.S. Application Data

(63) Continuation of application No. 10/653,318, filed on Sep. 2, 2003, now Pat. No. 7,731,028.

(51) Int. Cl.

| | |
|---|---|
| ***B65D 85/48*** | (2006.01) |
| ***B65B 23/00*** | (2006.01) |
| ***B65D 73/00*** | (2006.01) |
| ***B65D 81/05*** | (2006.01) |
| ***B65B 53/00*** | (2006.01) |

(52) U.S. Cl.

CPC ..... *B65B 23/00* (2013.01); *B65D 73/0014* (2013.01); *B65D 81/05* (2013.01); *B65D 85/48* (2013.01); *B65D 2585/6882* (2013.01); *B65B 53/00* (2013.01); *Y10S 229/939* (2013.01)

(58) Field of Classification Search

CPC ..... B65D 81/02; B65D 81/05
USPC ..... 206/495, 497, 557, 560, 565, 449, 454, 206/595–598, 583, 588, 194, 198, 325, 206/448; 53/461–463, 441, 450
See application file for complete search history.

(56) References Cited

U.S. PATENT DOCUMENTS

| | | | | |
|---|---|---|---|---|
| 1,676,238 A | | 7/1928 | Batty | |
| 1,816,598 A | | 7/1931 | Martin | |
| 2,005,967 A | | 6/1935 | Berdan | |
| 2,740,518 A | * | 4/1956 | Kincaid | 206/448 |
| 2,743,010 A | | 4/1956 | Koester | |
| 2,873,024 A | | 2/1959 | Koester | |
| 2,919,798 A | * | 1/1960 | Gottlieb | 206/577 |

(Continued)

OTHER PUBLICATIONS

Office Action dated Feb. 25, 2013 received in related U.S. Appl. No. 13/530,443.

(Continued)

*Primary Examiner* — Luan K Bui
*Assistant Examiner* — Rafael Ortiz
(74) *Attorney, Agent, or Firm* — Woodard, Emhardt, Moriarty, McNett & Henry LLP

(57) ABSTRACT

A product is mounted on a support pad and suspended on the pad by wrapping a stretch wrapping film around the combination of the pad and product. The borders of the pad extend beyond the borders of the product so the package containing the product can be stood on edge, but the edge of the product is spaced away from the surface on which the package is stood. The borders of the pad also include notches on the top and bottom of the pad that receive the stretch wrapping film away from the borders of the pad and closer to the product. Thus the product, secured to the pad, is suspended away from that surface. Multiple packages can be packed into a shipping container and the loaded container can be lifted and transported by a lift truck with lifting forks received in passageways formed in the container by notches in the bottom edges of the support pads. The pads and containers are made of die-cut corrugated fiberboard material although other material could be used.

22 Claims, 14 Drawing Sheets

(56) References Cited

U.S. PATENT DOCUMENTS

| | | | | | |
|---|---|---|---|---|---|
| 3,028,001 | A | | 4/1962 | Gleim | |
| 3,166,188 | A | * | 1/1965 | Koester | 206/448 |
| 3,389,785 | A | * | 6/1968 | Lidgard | 206/448 |
| 3,403,778 | A | | 10/1968 | Voytko et al. | |
| 3,749,233 | A | | 7/1973 | McCormick, Jr. | |
| 3,764,002 | A | | 10/1973 | Spiegel et al. | |
| 3,853,220 | A | | 12/1974 | Luray | |
| 3,884,356 | A | | 5/1975 | Lidgard | |
| 3,885,667 | A | | 5/1975 | Spiegel et al. | |
| 3,891,090 | A | | 6/1975 | Spiegel et al. | |
| 3,921,890 | A | | 11/1975 | Reihm | |
| 3,992,849 | A | * | 11/1976 | Lett, III | 53/449 |
| 4,085,847 | A | | 4/1978 | Jacalone | |
| 4,747,486 | A | | 5/1988 | Benno | |
| 4,865,200 | A | * | 9/1989 | Sullivan et al. | 206/583 |
| 5,105,946 | A | * | 4/1992 | McDowell | 206/454 |
| 5,219,073 | A | | 6/1993 | Cowie | |
| 5,323,896 | A | | 6/1994 | Jones | |
| 5,463,843 | A | | 11/1995 | Sharp | |
| 5,605,229 | A | | 2/1997 | Sowa | |
| 5,676,245 | A | | 10/1997 | Jones | |
| 5,741,535 | A | * | 4/1998 | Cope et al. | 426/124 |
| 5,794,542 | A | | 8/1998 | Besaw | |
| 5,894,932 | A | | 4/1999 | Harding et al. | |
| 5,918,744 | A | | 7/1999 | Bringard et al. | |
| 5,934,473 | A | * | 8/1999 | Belshe | 206/583 |
| RE36,412 | E | | 11/1999 | Jones | |
| 6,158,589 | A | | 12/2000 | Smith et al. | |
| 6,289,655 | B1 | * | 9/2001 | Ridgeway et al. | 53/449 |
| 6,550,222 | B2 | | 4/2003 | DeGrasse | |
| 6,564,532 | B2 | | 5/2003 | Gutche | |
| 6,920,981 | B2 | | 7/2005 | Lofgren et al. | |
| 2004/0074798 | A1 | | 4/2004 | Taylor et al. | |
| 2005/0183977 | A1 | | 8/2005 | Christensen | |
| 2005/0183978 | A1 | | 8/2005 | Christensen et al. | |
| 2008/0237088 | A1 | | 10/2008 | Carroll | |

OTHER PUBLICATIONS

Office Action dated Aug. 23, 2013 received in related U.S. Appl. No. 13/530,443, filed Jun. 22, 2012.

Wikipedia, Streetch Wrap, Feb. 19, 2014, http://en.wikipedia.org/wiki/stretch_wrap.

* cited by examiner

SUSPENSION PACKAGING SYSTEM AND METHOD

CROSS REFERENCE TO RELATED APPLICATIONS

The present application is a continuation of U.S. application Ser. No. 10/653,318, filed Sep. 2, 2005, which is incorporated by reference in its entirety.

BACKGROUND

The present disclosure relates generally to packaging for shipment of products whose configurations have length and width that are large relative to depth, and more particularly to packaging such products which are made of materials or have construction features which are easy to break or otherwise damage in shipping operations.

Current bulk packaging of windshields for the automotive after-market trade is predominantly configured to hold twenty-five or more windshields. Such packaging involves construction of a wooden frame with corrugated fiberboard attached around the framing, along with several other packaging components to protect various fragile contact points of the individual windshields. A considerable amount of labor is required to configure the packaging for use by the manufacturer of the glass. The containers are required to be "pre-erected" and they present difficulties in the shipping and storage of empty containers.

DESCRIPTION OF THE ILLUSTRATED EMBODIMENTS

Figure 1:
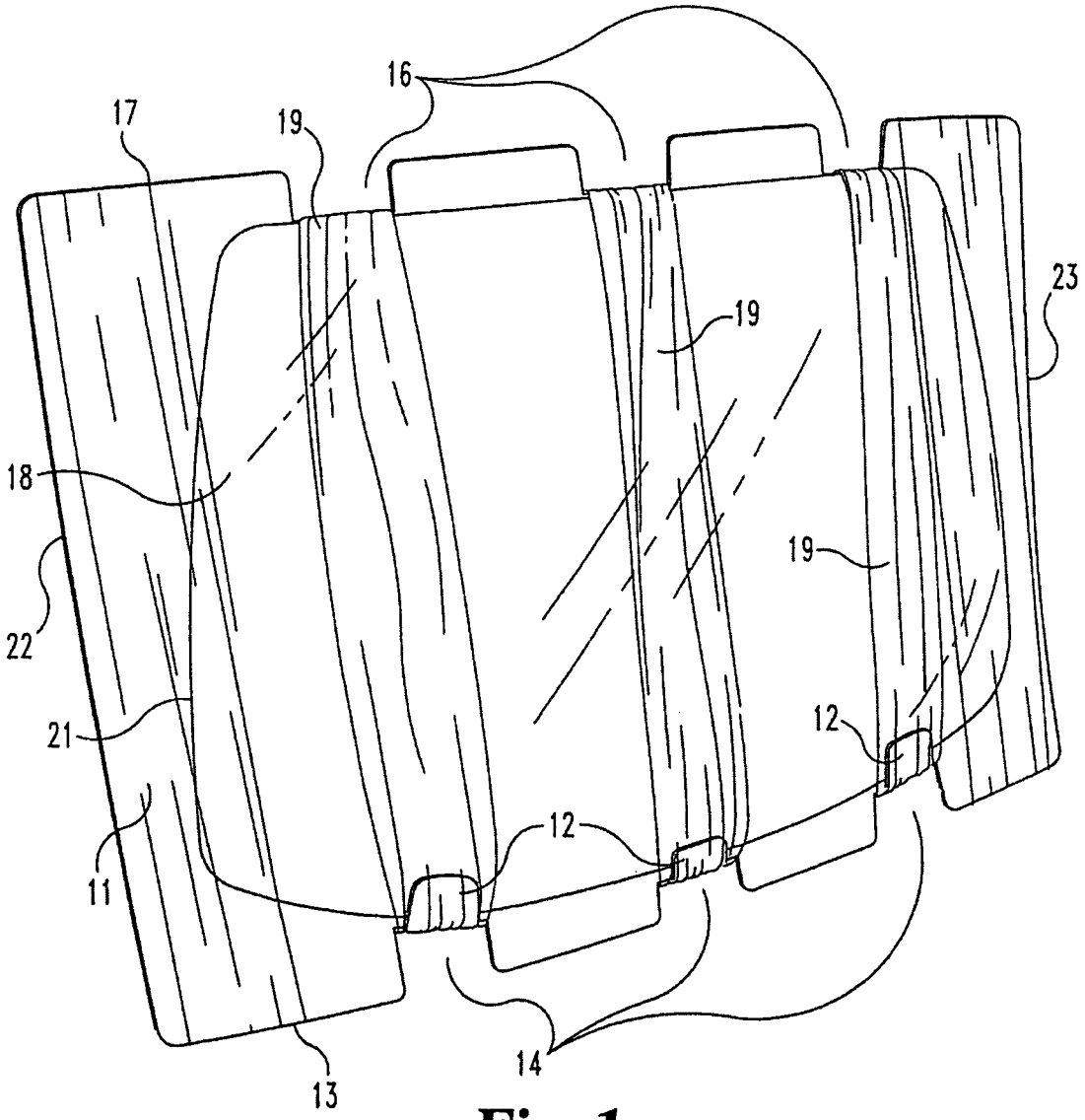
FIG. 1 is a front perspective view of a windshield package according to one embodiment of the present disclosure.

For the purpose of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

Figure 2:
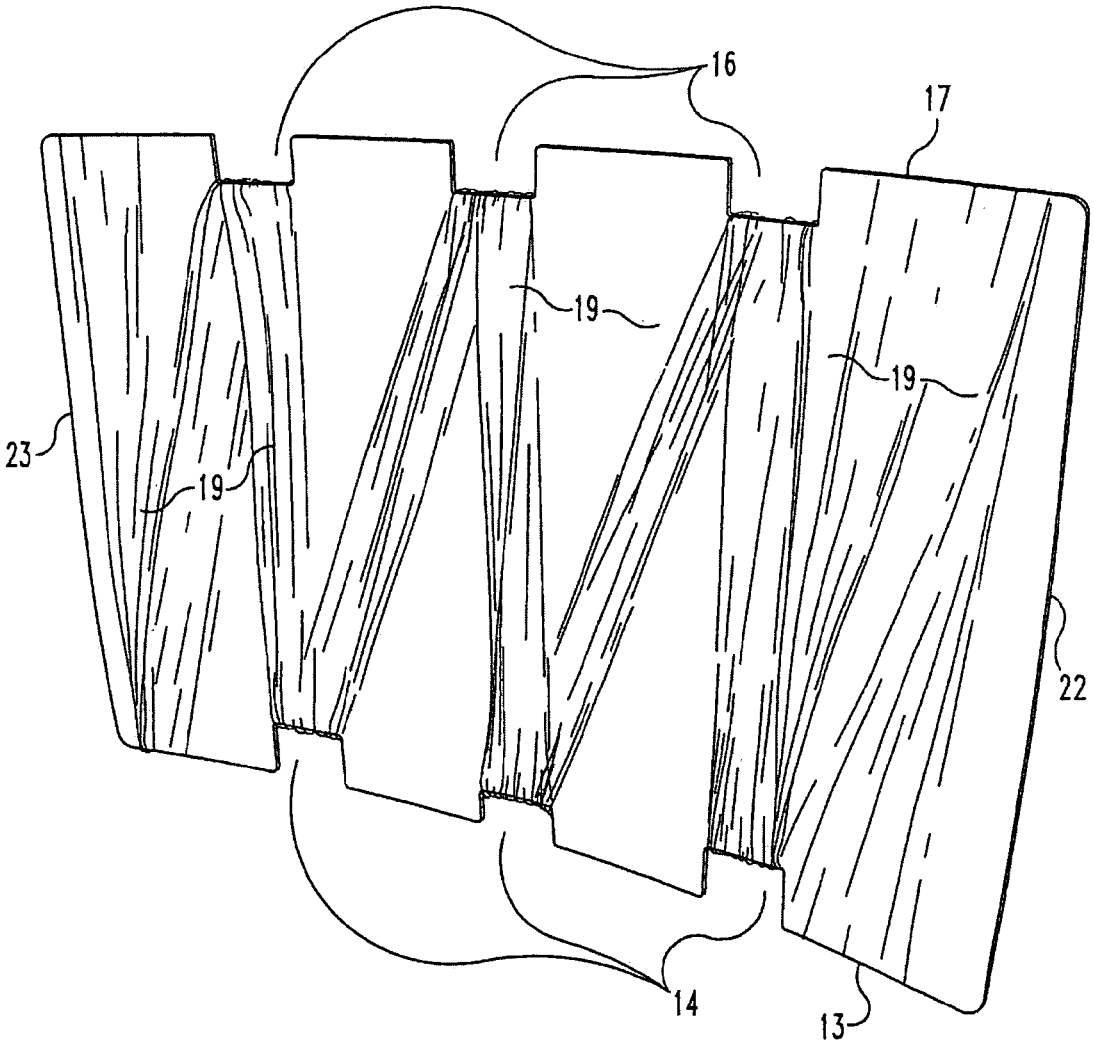
FIG. 2 is a rear perspective view of the package of FIG. 1.

Referring now to FIGS. 1 and 2, a package according to one embodiment of the present disclosure is shown. It includes a corrugated fiberboard pad 11 cut to provide three tabs 12 at the bottom edge 13 and which have been turned upward to produce notches 14. Similarly, three notches 16 have been provided in the upper edge 17. In these instances, instead of forming tabs at the notches, the material has been completely blanked out of the board.

A curved windshield 18 is mounted to the pad 11 and is secured to the pad by film stretch wrapped around the pad and the windshield as at 19. The wrapping material can be wrapped by machine or by hand, and the pattern can be random as long as there is control of location of the windshield on the pad so that the entire perimeter 21 of the windshield is well within the bottom and top edges 13 and 17 of the pad and the side edges 22 and 23 of the pad. The film wrapping through the notches and around the edge of the windshield at the top and around the tabs at the bottom is important. It is preferable that the wrapping from top to bottom is performed across the majority of the width of the windshield. While the wrapping from top to bottom notches can be parallel on either the front as shown in FIG. 1, or the back, it is preferable that there be continuous wrap from notches in the upper edge diagonally to notches in the lower edge on at least the front or the back and, preferably, on both the front and back of the package. A combination of this angled wrapping with straight wrapping from top notch to bottom notch and from portions of the top edge other than notches, to portions of the bottom edge both notched and without notches, is shown on the backside of the pad in FIG. 2. So the stretch wrapping of the windshield is adequate to suspend the windshield on the pad with all features of the windshield edges well within the area defined by the perimeter of the pad. The upturned tabs 12 held in place by the wrapping may assist in supporting the weight of the windshield during the wrapping and subsequent handling and transportation.

Figure 16:
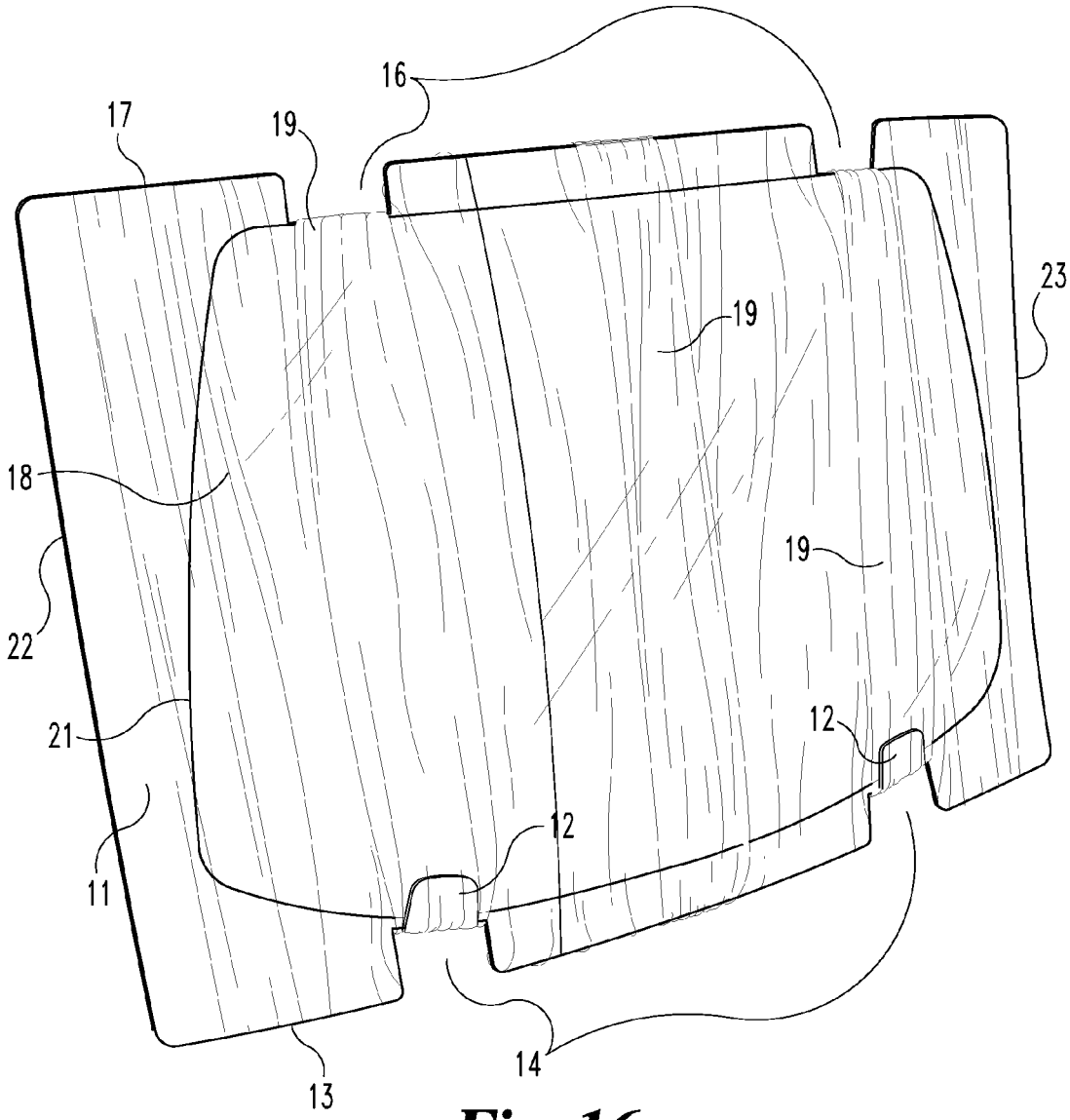
FIG. 16 is a front perspective view of a windshield package according to an alternative embodiment.

Referring now to FIG. 16, an alternate embodiment of the present disclosure is shown including curved windshield 18 mounted to pad 11 by film stretch wrapped around the pad and the windshield as at 19. The stretch wrapping is spread out over the whole width of windshield 18 and covers the entire perimeter of windshield 18.

Figure 3:
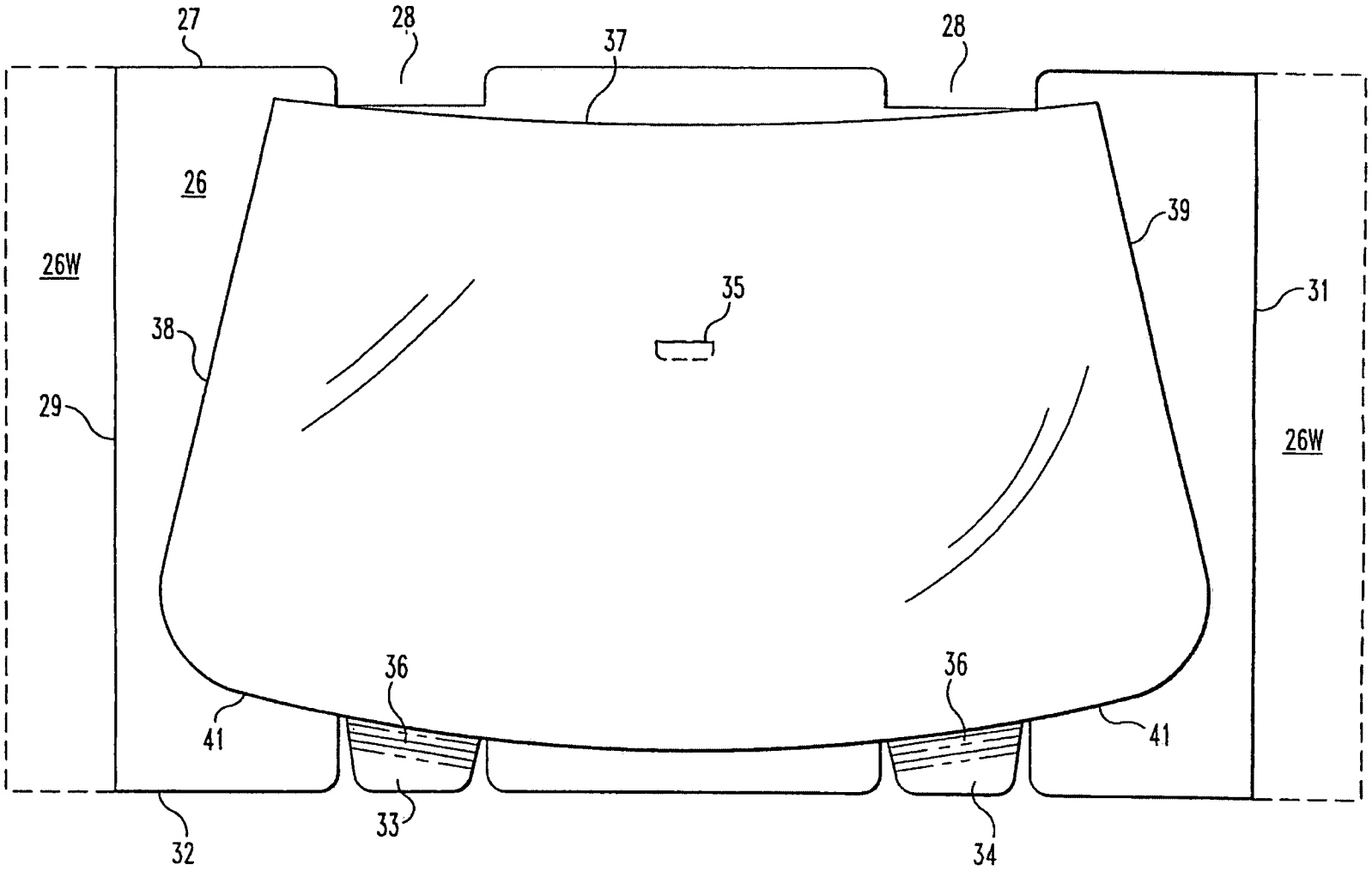
FIG. 3 is a front view of a pattern for a two-tab corrugated fiberboard blank for a windshield suspension pad according to another embodiment of the disclosure.

Referring now to FIG. 3, there is shown a drawing pattern for a die-cut pad 26 of 275 pound (#) double-walled corrugated fiberboard material. Dimensions in inches are shown as an example. In the resulting die-cut pad, the top edge 27 has two notches 28 punched completely out. The side edges 29 and 31 are straight. The bottom edge 32 is notched at four places to form two tabs 33 and 34 with light score lines such as 36 to facilitate folding them forward. A hand hole 35 is blanked out of the middle. The printed outline of the windshield to be suspended on this pad is printed on the pad as shown at 37, 38, 39 and 41. This outline provides appropriate guidelines for the placement location of the windshield on the pad for stretch wrapping. Various other ways for proper product placement can be used. Another example is die cuts to produces holes, marks or tabs for orientation points. Of course, such cuts can be provided at the same time that the pad is cut from stock.

Figure 4:
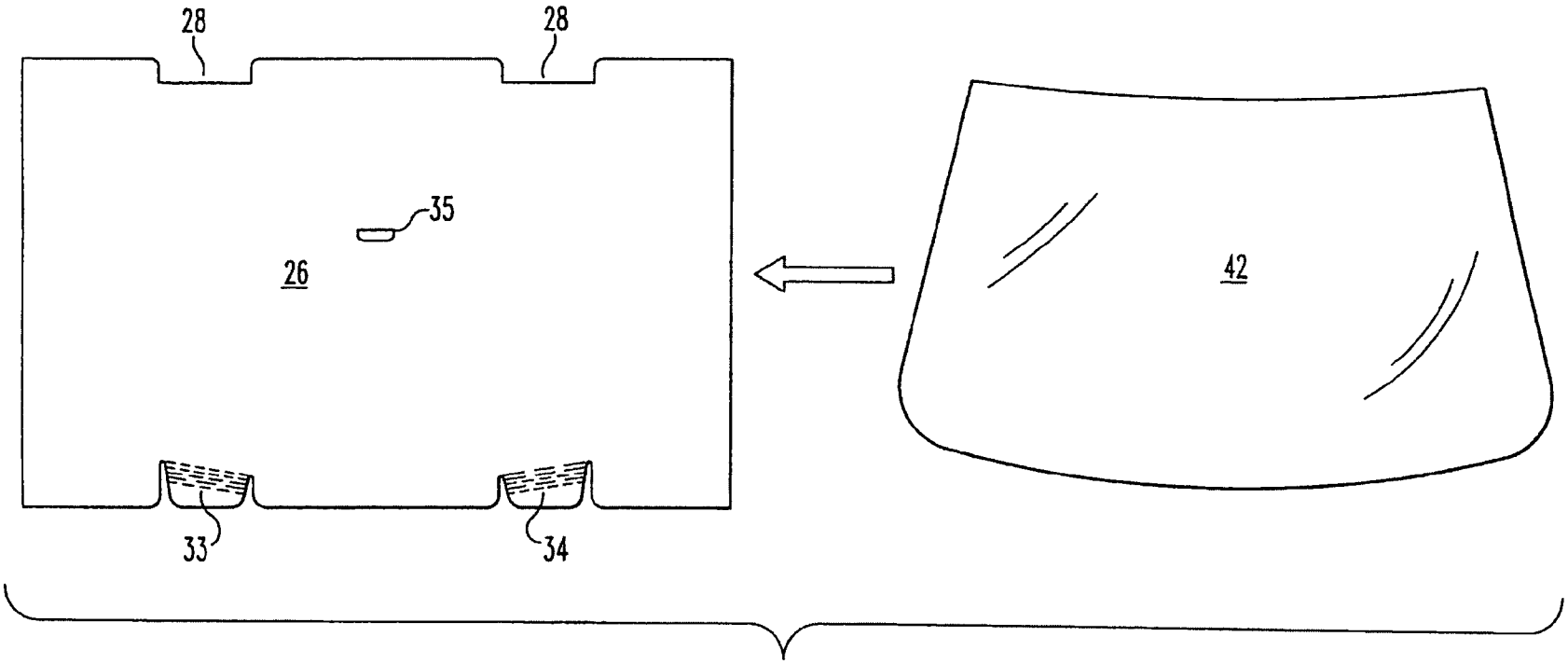
FIG. 4 is a schematic diagram showing a windshield about to be installed on a fiberboard blank according to the pattern of FIG. 3.
Figure 5:
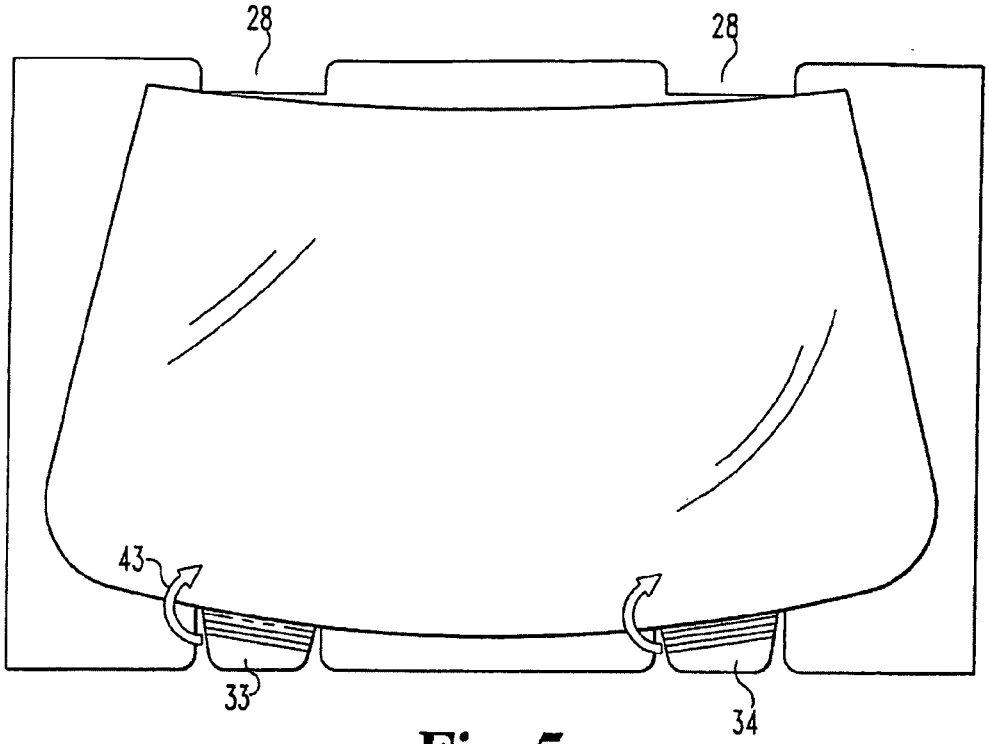
FIG. 5 is a view showing the windshield installed on the blank.
Figure 6:
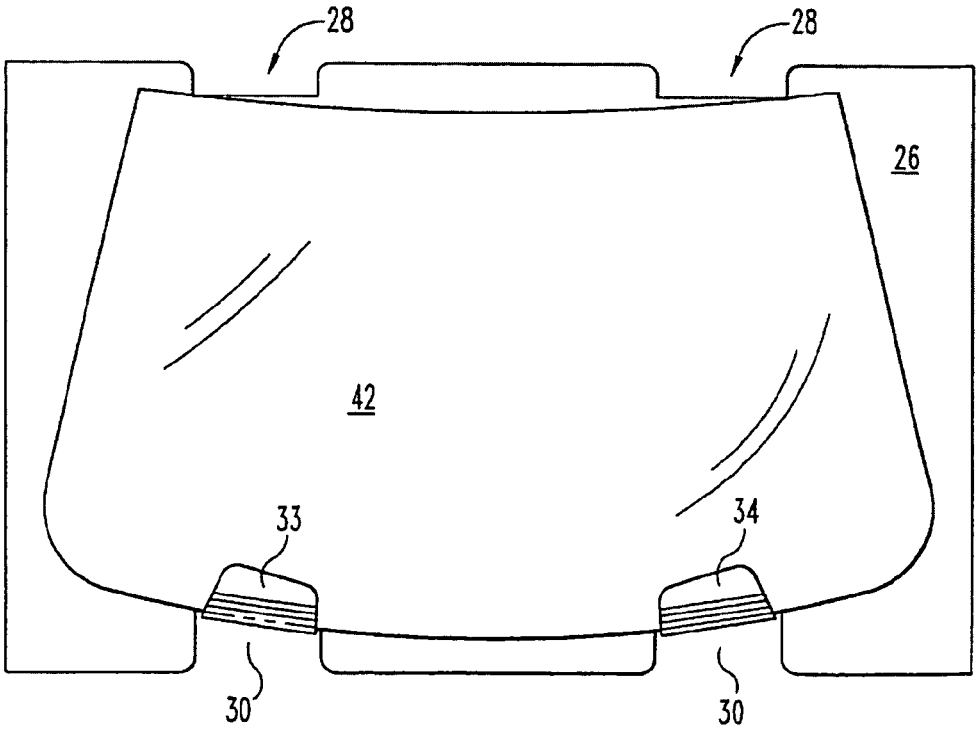
FIG. 6 shows the tabs folded up over the bottom edge of the windshield.

Referring now to FIG. 4, the blank 26 is shown ready for mounting the windshield 42 on it. The windshield is placed on the pad as shown in FIG. 5, and the tabs 33 and 34 are turned upward and forward in the direction of arrows 43 so that they overlap the front face of the windshield at the bottom edge as shown in FIG. 6. The score lines such as 36 on the pad 26 assure that when the tabs are bent forward and upward the windshield will be properly located with its lower edge overlying the pattern drawn or otherwise placed on the front of the pad 26.

Figure 7:
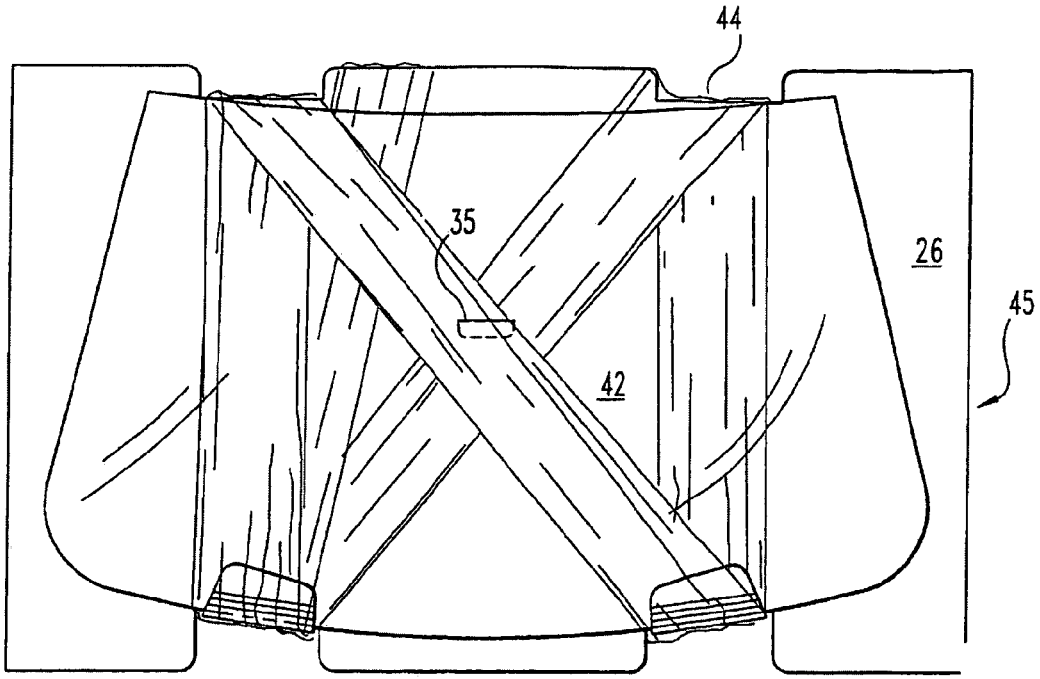
FIG. 7 shows the windshield and pad wrapped with stretch wrap film suspending the windshield on the pad and thus forming a windshield package.

When the windshield has been positioned such that it matches the pattern of lines, the stretch wrap film 44 is stretch wrapped around the pad and the windshield, with the film being wrapped through notches 28 at the top and around and covering the tabs 33 and 34 at the bottom, securely locating the windshield on the pad. Stretch wrap is continued as needed or desired around the front of the windshield and the back of the pad. When the amount of stretch wrapping has been completed to provide the degree of attachment and protection desired, the wrap film can be cut, and the end portion of the film adhered to the portion already wrapped, using the benefit of the cohesive nature of the wrapping film. If desired, the amount of wrap shown on the front of the windshield at FIG. 7, can be more than necessary to simply suspend the windshield securely on the pad, and/or can be spread out the whole width of the windshield, to serve additional useful purpose as will be described later herein.

Figure 8:
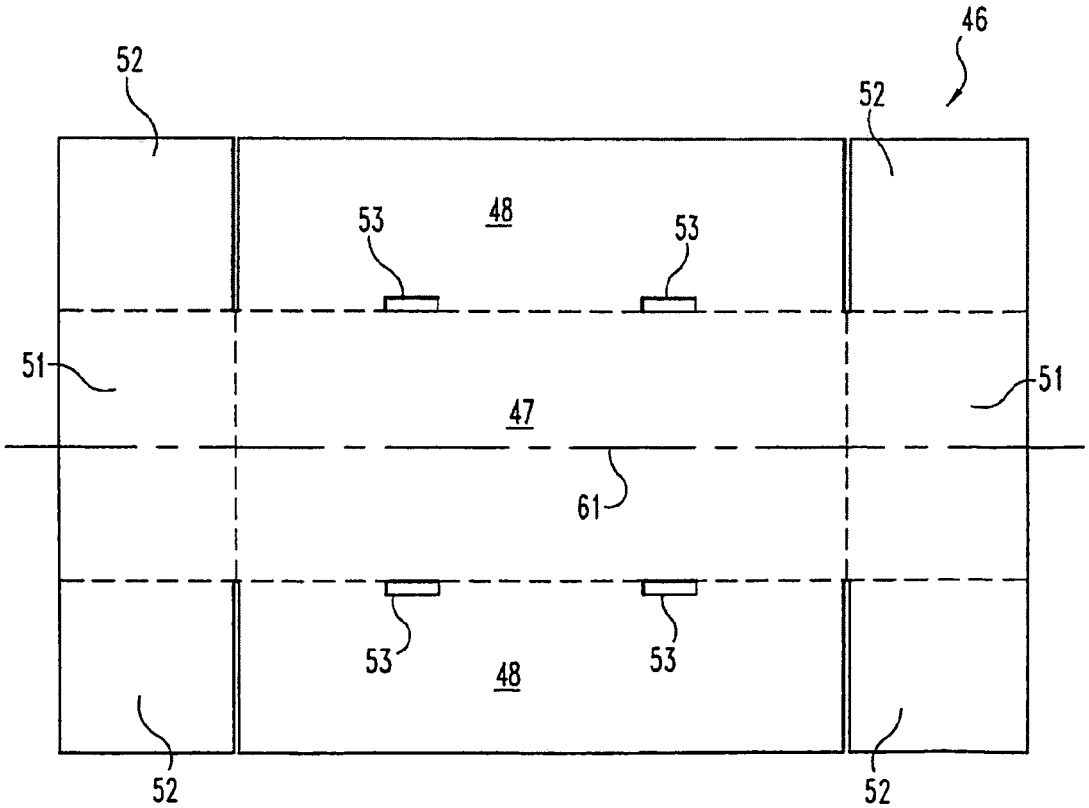
FIG. 8 shows a corrugated fiberboard blank for a shipping container bottom tray according to one aspect of the disclosure.
Figure 9:
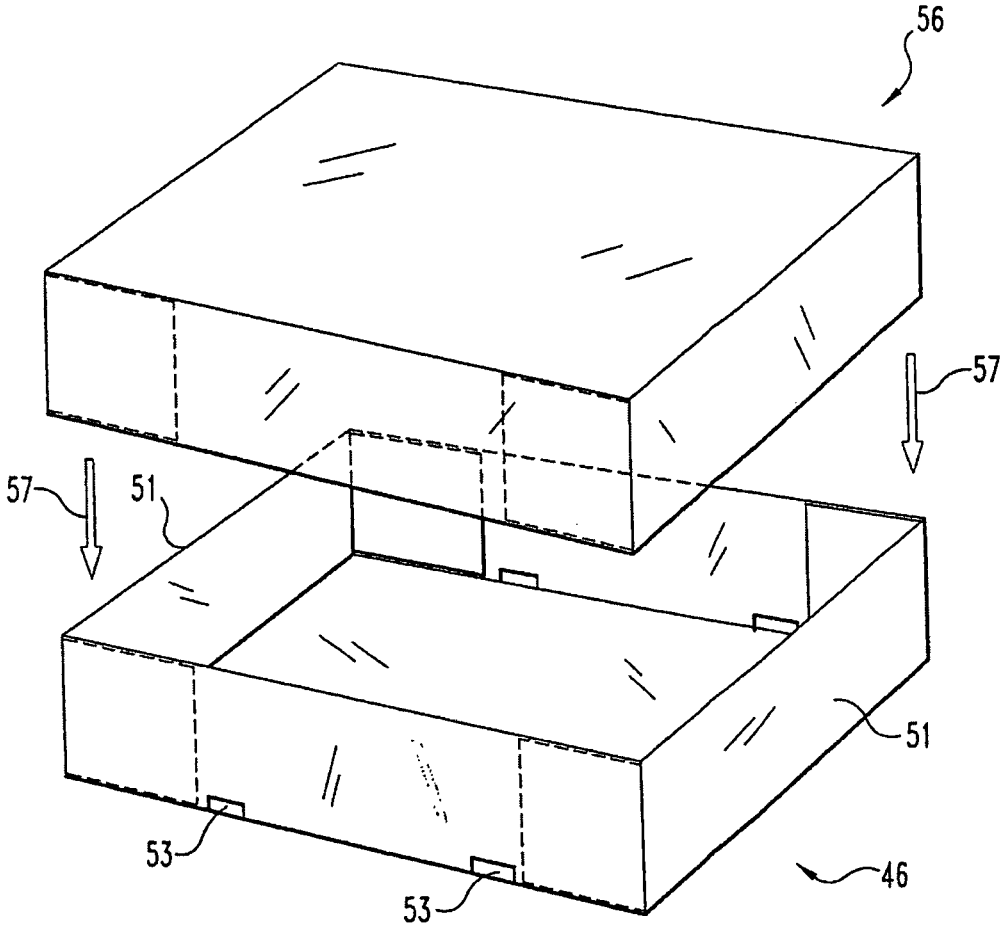
FIG. 9 shows the blank of FIG. 8 erected to form a bottom tray, and a similar blank erected to form a top tray or lid of the shipping container to be filled with the windshield packages.

Referring now to FIG. 8, a die-cut blank 46 of double wall. 275# corrugated fiberboard or any other appropriate strength material is shown for the bottom "tray" of a shipping container. It has the usual bottom panel 47 with sidewalls 48, end walls 51 and flaps 52 on the end walls. The sidewalls have holes punched at 53. This blank can be erected as shown in FIG. 9, gluing or otherwise securing the flaps 52 to the sidewalls in conventional fashion. A top 56 can be made according to the same form or pattern blank as for the bottom tray, but omitting holes 53, and made slightly larger than the bottom tray, to slide down on it in the direction of arrows 57 to close the shipper.

Figure 10:
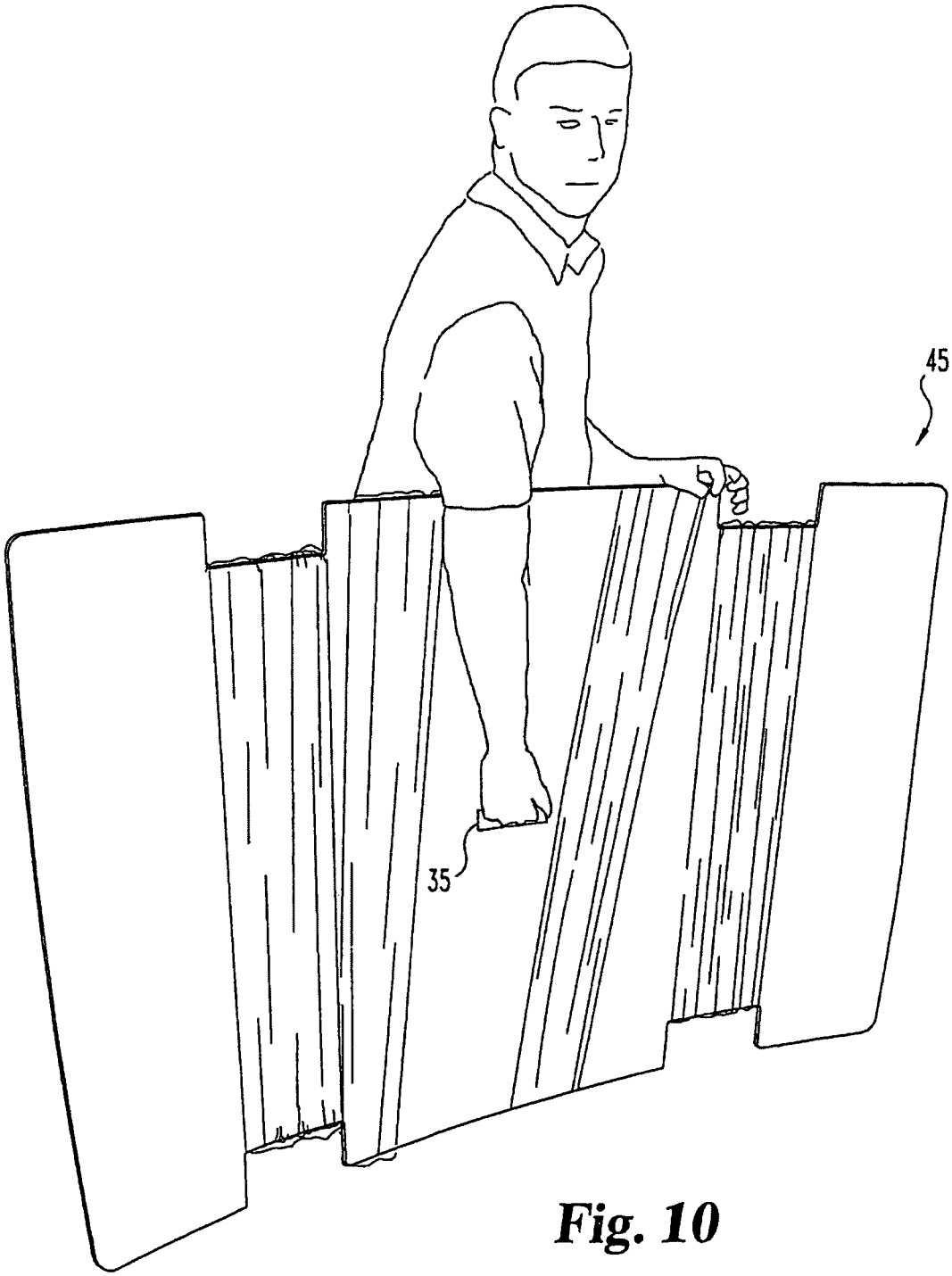
FIG. 10 is a view of the back of a package suspending a windshield therein and being carried conveniently by a worker.
Figure 11:
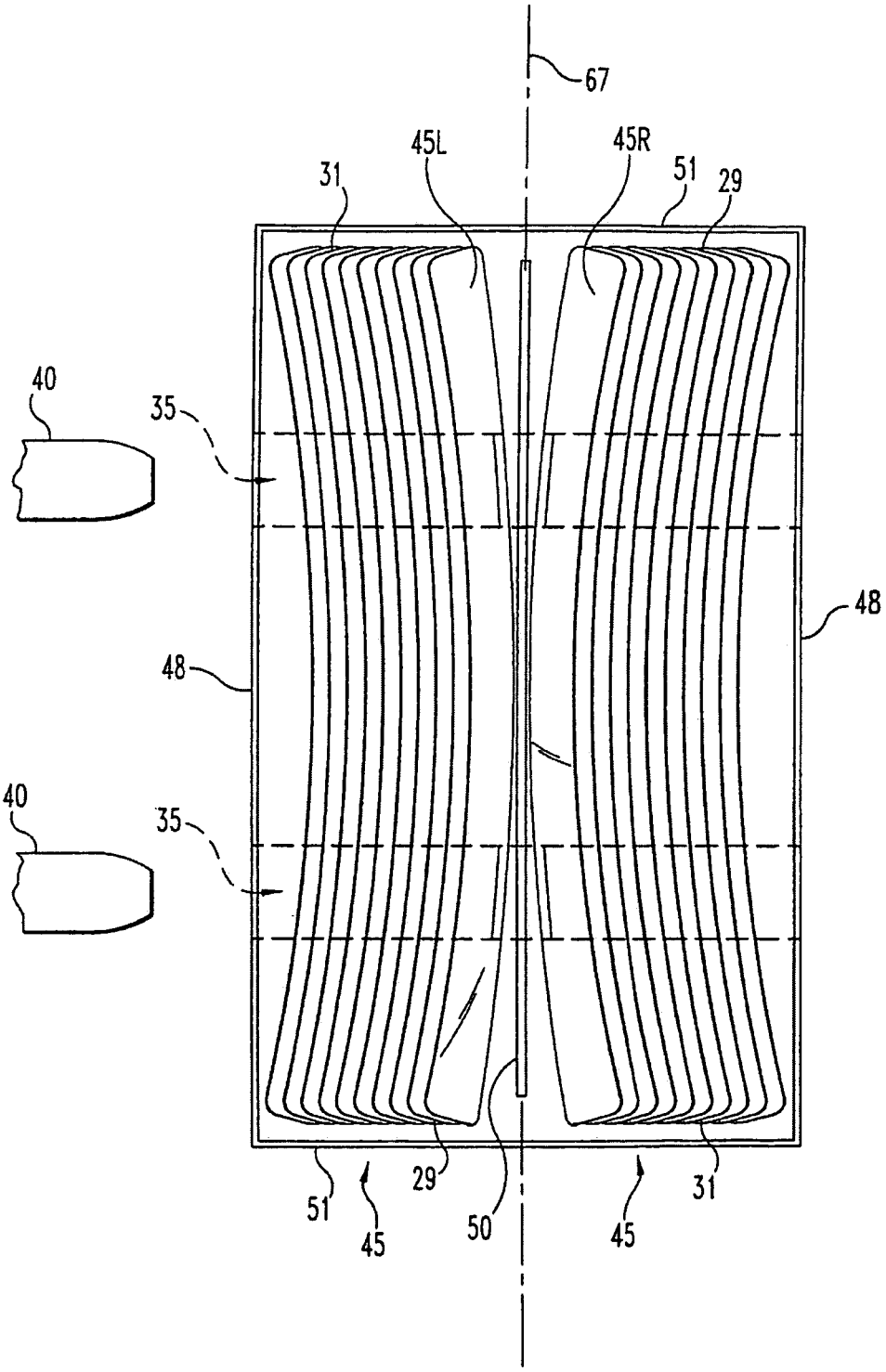
FIG. 11 is a top view of a plurality of such packages arranged in an X-shaped configuration in a container bottom tray.
Figure 12:
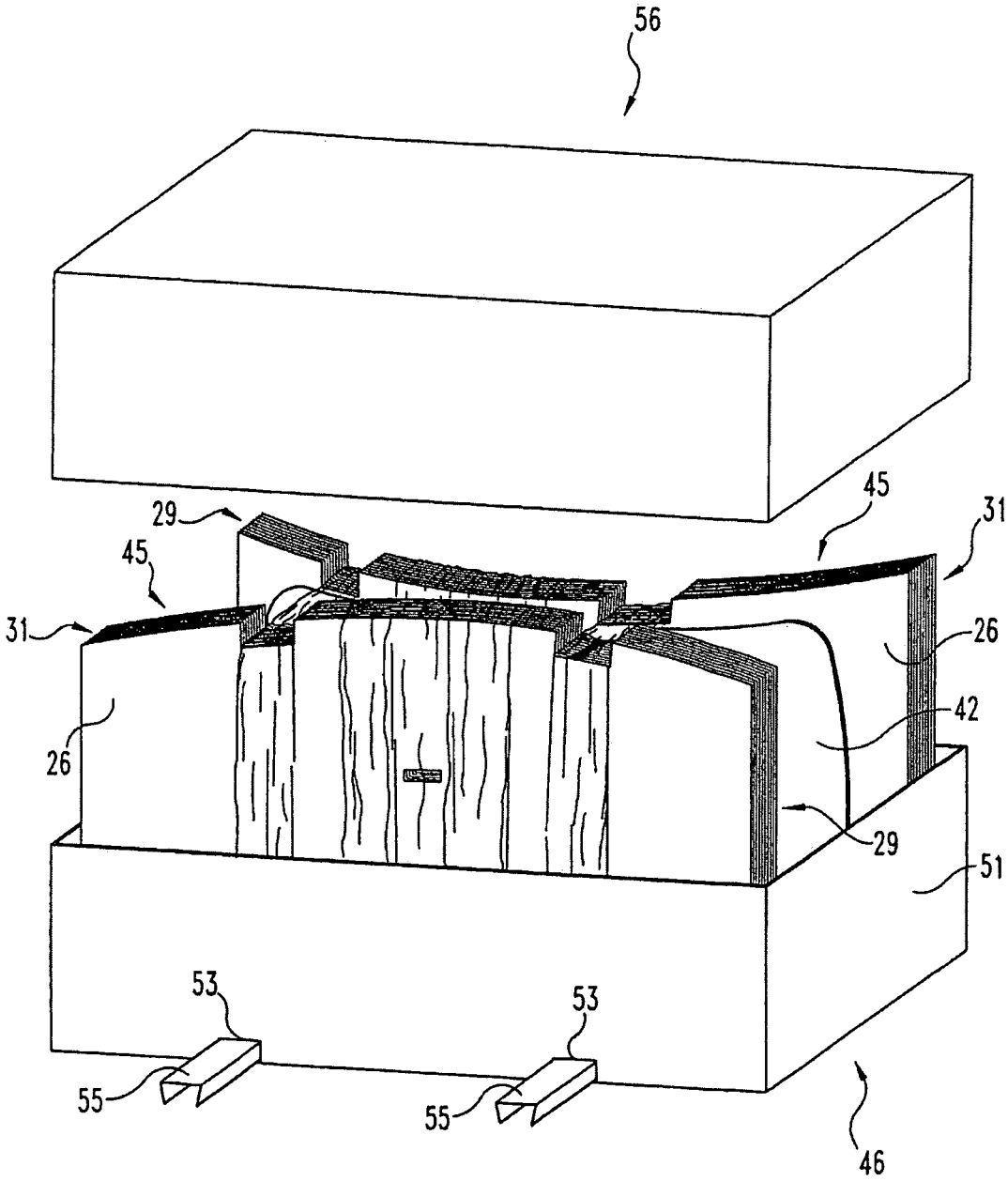
FIG. 12 is a perspective view showing the packages in a shipping container ready for installation of the top.

Prior to closing the shipper, it is filled with window packages such as described above with reference to FIGS. 3-7. After wrapping the window, the wrapped window package 45 (FIG. 7) can be picked up and conveniently carried by the worker standing at either the front of the wrapped windshield and pad, or at the rear, and inserting a hand in the hand hole 35 as shown in FIG. 10, and picking up and carrying the windshield to the shipper tray 46 and placing the windshield in the tray with the bottom edge 32 of the pad resting on the bottom 47 of the tray. Since the windshield is curved, the wrapping with stretch wrap imparts a curve to the pad. Such curve is shown in FIGS. 1, 2, 11 and 12 where the pad forms a planar curve that substantially conforms to the periphery of the concave back surface. Therefore, the windshields will be placed in the tray in an "X" configuration as shown in FIGS. 11 and 12. By placing them in this configuration, instead of nesting all windshield packages in one orientation, half of them are oriented in one direction and the other half in the other direction. Therefore the convex front surfaces of all of the packages face inwardly toward the center plane 61 (FIGS. 8 and 11) of the container. The two windshield packages 45L and 45R at the center of the container could have their convex front faces in abutting relationship. Therefore, it may be desirable that the wrapping for these two packages be extra thick to prevent any left to right (FIG. 11) shifting of the packages. Alternatively, and more likely than extra wrapping on center packages, some packing material can be placed between these facing windshield packages 45L and 45R. An example is one double wall panel 50 of corrugated fiberboard. The rest of the packages nest. The side edges 29 and 31 of the pads are close enough to the end walls 51 of the tray that there is no shifting sideways of the windshields within the tray.

Figure 13:
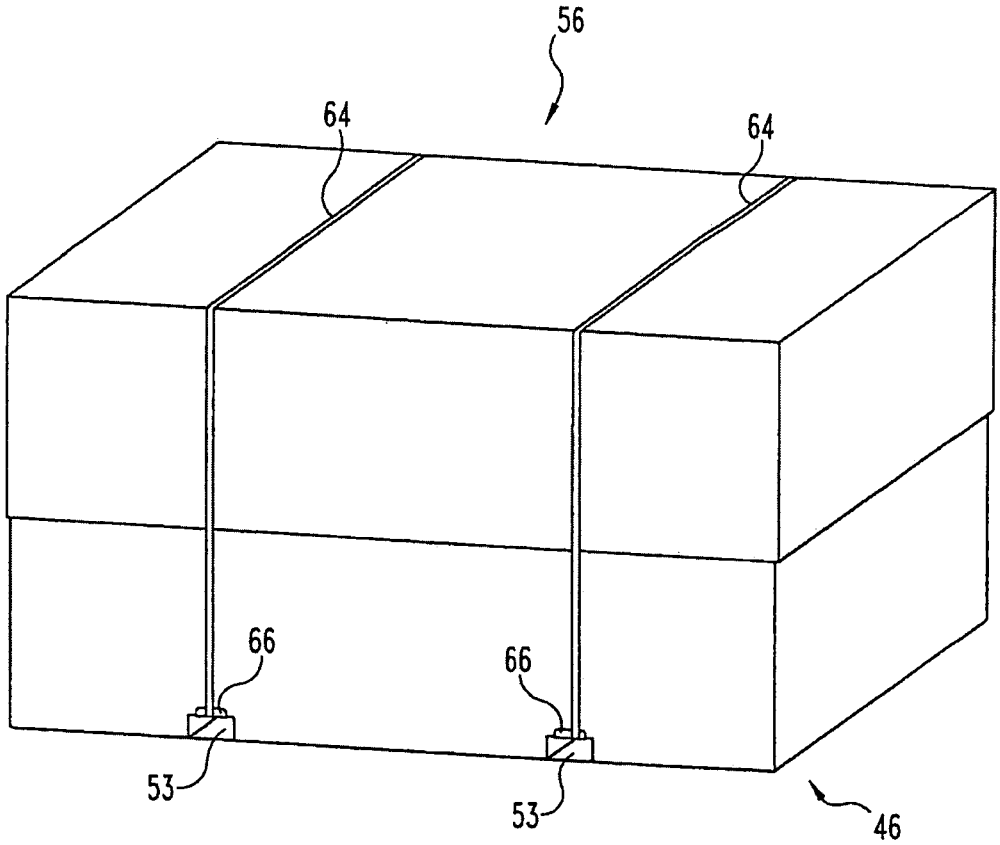
FIG. 13 shows the container closed and strapped closed.
Figure 14:
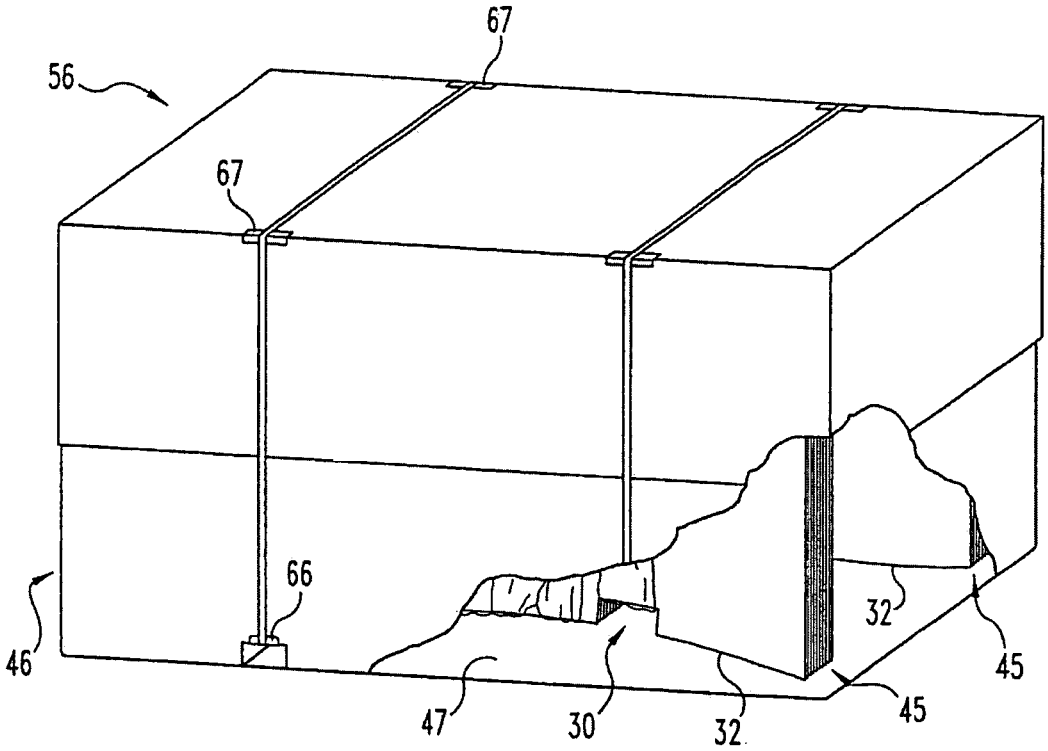
FIG. 14 is similar to FIG. 13 but with a portion broken out of the corner to show the pads mounted directly on the floor of the container and with the bottom notches in the pad oriented for access by the lifting forks of a lift truck.

Bottom notches 14 were mentioned with reference to the embodiment of FIGS. 1 and 2. Similarly, there are the bottom notches 30 in the pads of the illustrations of the two-notch embodiment of the FIGS. 3-7 and 10-14. According to another feature of the disclosure mentioned with reference to FIG. 8, there are four holes 53 in the sidewalls 48 of the bottom tray 46 of the container. As best shown in FIG. 14, the bottom edges 32 of the pads rest on the floor 47 of the tray 46. The top of each of the notches 30 is spaced above the tray bottom 47. The holes 53 are aligned with the notches in the pads, all of which are aligned in two rows 35 (FIG. 11) when the containers have been packed with the packages 45. The holes 53 provide access to the lifting forks 40 of a forklift truck. Thus, it is possible to use the packed containers according to the present disclosure, without pallets, because the forks of the lift truck can enter the access holes 53 and pass through notches 30 under the windshields and lift the whole shipper and transport it as needed. The upturned tabs 34, and stretch wrapping around them, provide protection for the pads and the suspended windshield glasses. If further protection is desired to assure prevention of edge crush of the pads by lifting forks at notches 30, some tubes or downwardly opening channels made of corrugated fiberboard or other material can be placed from the access holes 53 in one tray wall and extend through the passageways formed by the bottom notches 30 of the pads to the access holes in the opposite wall of the tray. An example of such channel is shown in FIG. 12 where two such channels 55 are shown partially inserted into the two passageways 35 (FIG. 11) formed by the two notches 30 each, of all of the pads in a filled container bottom tray. This is a way that, if needed or desired, additional protection can be provided in the tops of the passageways formed by the notches 30 in all of the window packages from one of the walls 48 through the container to the other wall 48. After a container is filled, the lid 56 can be installed and can rest on the upper edges 27 of the suspension pads and strapped closed by poly strapping 64 in two places, running through the access holes 53, and under the pads through the notches 30. If desired to preclude any edge crush by the strapping 64, some tabs 66 of fiberboard or other material can be folded around the upper edges of the holes 53 as shown in FIG. 13. Similar protection can be provided at other locations such as 67.

Packaging according to the present disclosure may be done by performing the stretch wrapping by hand. But various stretch wrapping machines are known. Examples are referenced in U.S. Pat. Nos. 6,564,532 and 6,550,222, and the references cited therein. Another is the "Yellow Jacket 110" which is a horizontal stretch wrapping machine by Wiley Metal, of Marion Ind., U.S.A. So the product and pad can be stretch wrapped by machine, if desired.

The packaging of automotive window products individually and "collating" a number of the packages into a shipping container can have real advantages over conventional practices. It allows safer and easier handling of individual glass components, as the stretch wrapping can be extensive enough, if desired, to cover the entire perimeter of the glass and thereby preclude encounter of any edge of glass by a worker while loading the packages into a shipping container. Additionally, the cohesive properties of the stretch wrap film, as one-package nests against another, can lend stability to the bulk packs of multiple packages, by virtually eliminating the tendency of windshields to "shingle", i.e. slide out of the bottom of current conventional packaging. It can also reduce the incidence of damage in transit.

In the foregoing description, the illustrated embodiments show forwardly and upwardly turned bottom tabs on the pad. The weight and application of the product to the pad can have a bearing on whether it is desirable or necessary to use tabs at the bottom or at the top (at the location of the notches 28) or both bottom and top, or not at all. If the glass or other product to be suspended to a pad according to the disclosure is relatively flat, it may be desirable to have notches in the side edges of the pad as well as in the top and bottom, and stretch wrap film around the product, not only in and through the notches in the top and bottom edges, but also in and through notches in the side edges.

It should be understood that the system described herein can be employed using suspension pad materials other than 350 pound, double walled corrugated fiberboard. It depends on the nature and weight of the product to be suspended. Since the space requirement of the suspended product is usually significantly greater in length and width, than in thickness, it is usually suspended such that the package will be packed on edge in the shipper. Therefore, the fiberboard will be oriented with the flutes running vertically to provide the needed vertical column strength. It is conceivable that a pad with only one facing secured to the corrugated media, might be sufficient in some applications.

It is also conceivable that the pad be made of material other than corrugated fiberboard. A plastic or metal might also be used. Desirability and height of stacking containers in warehouses or vehicles, weight and nature of the packaged product, and other considerations could dictate features of pads made of other materials, to provide the necessary column or top-to-bottom stacking strength of the pad. For example, if plastic were used, it might be necessary to have a corrugated component. Another consideration is the condition of the surface of the pad material, which is contacted by the product to be suspended. It cannot be abrasive, if abrasion of the product portion in contact would be detrimental to the needed appearance or performance of the product. Otherwise, it may be necessary to stretch wrap portions of the pad before placing the product on the pad, so that the stretch wrap film will protect the pad-engaging portions of the product from abrasion, and then wrap the product onto the pad. Alternatively, a non-abrasive coating can be provided on the front of the pad where the product will contact it.

The thickness of the wrap film used depends on what is necessary to get a snug covering of the product on the pad. Where the product will be machine-wrapped onto the pad, film selected will be dictated largely by optimum effectiveness of performance of the wrapping machine.

If, instead of bulk shipping of ten to thirty or more packages, only one package is to be shipped, a simple container can be employed. If the product is curved, as for a windshield or backlight (back window), the corners may appear to be more vulnerable than inboard portions of the window. Dunnage can be placed in the container if desired so that the corners of the pad remain properly situated in the corners of the container. The corners of the glass, being well inboard from the corners of the container, are well protected. If desired, instead of adding dunnage, pad extension panels or "wings" 26W (FIG. 3) can be provided by scoring or creasing the pad at locations 29 and 31. This will allow the panels to be folded forward at a ninety-degree angle from the plane of the face of the pad and extend across the width or short dimension of the shipping container. The short dimension will be relatively small, as the container is containing only one product package. Therefore the extension panels locate the pad in the container not only side-to-side, but also front-to-rear and, with the back of the pad located against the back of the container, and corners of the product touching or near the front of the pad, the edges and corners of the product are kept away from the front of the container.

In the description above, the packaged product has been made of glass. The packaging described herein is useful for the packaging and shipping of a variety of other products, where the product is three-dimensional but the x-axis and y-axis dimensions are significantly greater than the z-axis dimension. Frequently, for various reasons such as, for example, convenience in removal of a certain package from a group, or to avoid warp, it is preferred to pack, store and ship the products oriented on an edge, like books in a bookcase. In the above examples, the side-to-side (x-axis) and top-to-bottom (y-axis) dimensions are significantly greater for the curved windshield than is the maximum dimension on the front-to-back (z-axis) i.e. the distance between imaginary parallel planes, one of which touches the most forward point of the glass and the other of which touches the most backward point of the glass.

Figure 15:
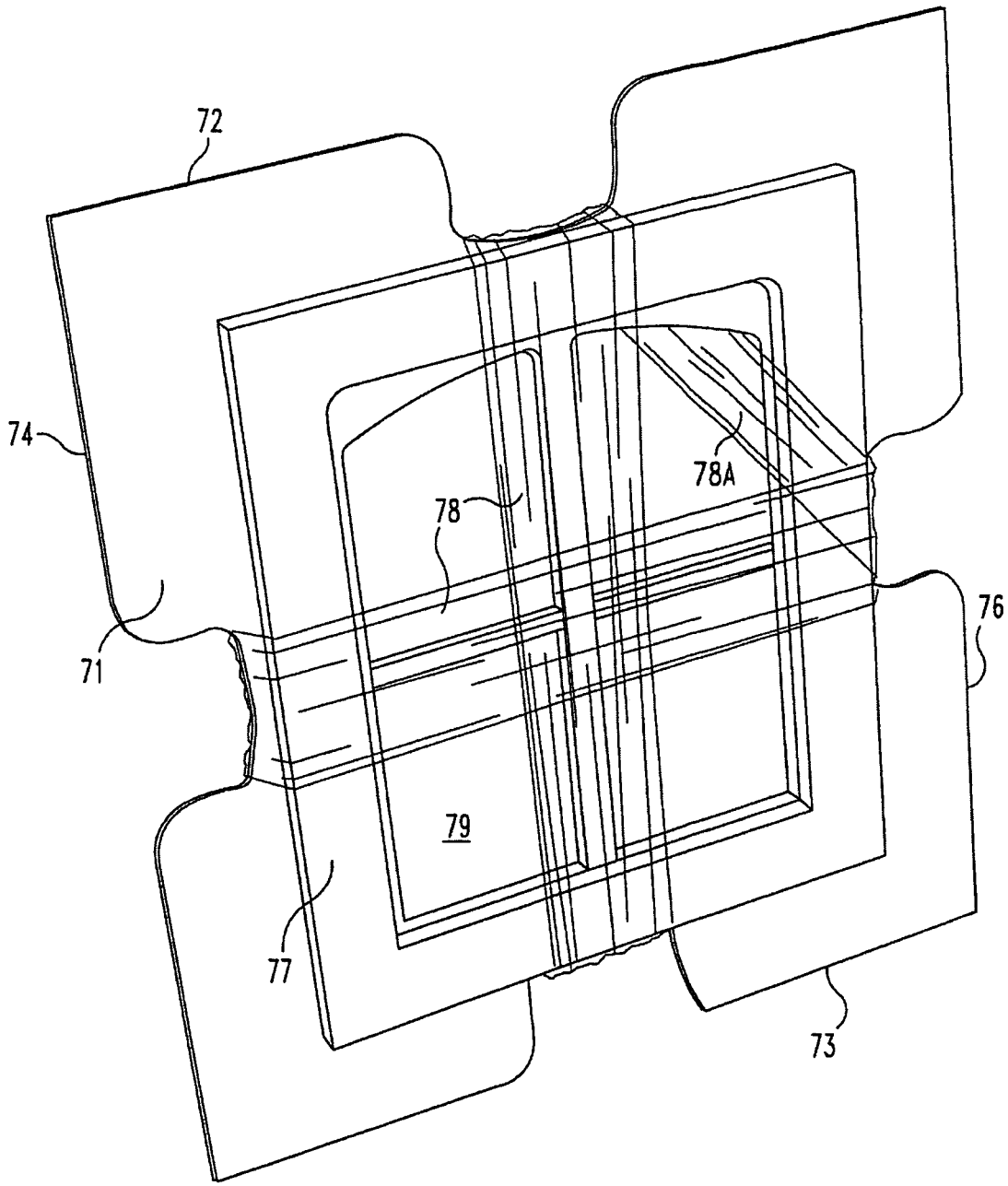
FIG. 15 is a front perspective view of a cabinet door package prepared according to an embodiment of the present disclosure.

Another product having such high and wide relative to front-to-rear dimensional relationships is shown in FIG. 15. It is a furniture cabinet door, with a glass window in it. Although the door without the window might not be considered fragile, it is desirable it not be damaged in packaging or shipping. The disclosed system avoids risk of damage that could occur on the bottom edge if the door were resting on that edge. So referring to FIG. 15, the pad 71 of corrugated fiberboard has top, bottom, left and right edges 72, 73, 74 and 76, respectively. Each of these edges has a notch in it. The cabinet door 77 is suspended on the pad by stretch wrapping stretch wrap film 78 from top to bottom edge notches and side-to-side edge notches as shown. The wrapping in the front envelops the door and pad at the front, and crosses in the front and back in whatever is found most convenient for the wrapping personnel or wrapping machinery used. Since a single continuous length of film 78 can be used in this example as in the above-described examples, portions of the wrap can be at angles between notches as at 78A in front or in back or both, whatever is convenient and sufficient to hold the door snugly against the pad and within the perimeter of the pad. In any case, the entire perimeter of the door is within the entire perimeter of the support pad, even considering the notch contour as part of the perimeter of the pad. Pad and wrapping technique can be tailored to the particular product to be suspended. In any case, the weight of the product is not transmitted directly from a portion of the product to any portion of the container in which it is shipped. The product is suspended on the pad, and the weight is transmitted through the pad to the container, thus protecting the product from damage. Of course, the window 79 in the door is amply protected.

The pad for the package of FIG. 15, with the single notch in each edge, results in a sort of clover shaped pad. Multiple side edge notches and top and bottom edge notches can be provided if desired for best product suspension, depending on the nature of the product packaged.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow.

What is claimed is:

1. A suspension packaging system for packaging a curved product having a height, a top surface, a bottom surface and a concave back surface, the system comprising:

a suspension pad configured specifically for use with the curved product, said suspension pad comprising a front side, a rear side, a top edge, a bottom edge, a left edge, a right edge, a first notch extending inwardly from said bottom edge, a second notch extending inwardly from said bottom edge, a third notch extending inwardly from said top edge and a fourth notch extending inwardly from said top edge, wherein said suspension pad is taller than the height of the product, wherein a distance between said first and third notches is approximately equal to the height of the curved product, wherein said suspension pad is adapted to be curved in a substantially continuous curve along substantially its entire width and wherein an entirety of said top edge of said suspension pad is substantially free of bends or creases that would impair said top edge from curving when said suspension pad bends and forms a planar curve that substantially conforms to the concave back surface of the curved product; and a stretch wrapping film comprising a stretchable material that exhibits elastic recovery when used as stretch film, wherein said stretch wrapping film is adapted to be stretched around the curved product and said suspension pad and be received in said first, second, third and fourth notches to secure the curved product to said suspension pad, wherein said suspension pad is adapted to bend and form a planar curve that conforms to the concave back surface of the product when said suspension pad is secured to the curved product with said stretch wrapping film and wherein said top edge of said suspension pad is adapted to define a continuous curved shape encompassing the entire top edge of said suspension pad when said suspension pad forms a planar curve.

2. The suspension packaging system of claim 1, wherein said suspension pad is adapted to conform to a periphery of the concave back surface such that said suspension pad abuts substantially an entire periphery of the concave back surface of the product.

3. The suspension packaging system of claim 2, wherein said top edge of said suspension pad defines a straight shape before the curved product is secured on said suspension pad by said stretch wrapping film.

4. The suspension packaging system of claim 1, further comprising a container adapted to hold said suspension pad bent in a planar curve with the curved product secured to said suspension pad with said stretch wrapping film, wherein said container and said suspension pad are constructed and arranged to suspend the curved product within said container such that no portion of the curved product contacts or is directly adjacent to said container.

5. The suspension packaging system of claim 4, wherein said container and said suspension pad are not fastened together such that said suspension pad with the curved product secured to said suspension pad with said stretch wrapping film can be inserted and removed from said container as an intact unit without damaging said container or said curved product or disassembling said container besides opening it.

6. The suspension packaging system of claim 5, wherein said container is constructed and arranged to hold a single suspension pad with the curved product secured to said suspension pad.

7. The suspension packaging system of claim 6, wherein said suspension pad further comprises a first extension panel positioned along said left edge of said suspension pad and a second extension panel positioned along said right edge of said suspension pad, wherein said first and second extension panels can be folded relative to said suspension pad to abut interior walls of said container positioned forward and rearward of said suspension pad to secure the suspension pad from moving relative to said container.

8. The suspension packaging system of claim 4, wherein said container and said suspension pad are constructed and arranged to transport said suspension pad and the curved product in a vertical orientation.

9. The suspension packaging system of claim 7, wherein said container and said suspension pad are constructed and arranged such that, when the curved product is suspended within said container on said suspension pad, said container and said suspension pad define an area below the curved product within said container that is substantially free of bracing or support elements.

10. The suspension packaging system of claim 5, wherein said suspension pad further comprises a centrally positioned hand hole positioned inside of the periphery of said concave back surface of said curved product constructed and arranged so that when the curved product is secured to said suspension pad by said stretch wrapping film, said hand hole is positioned to allow an individual to pick up and carry said suspension pad and the curved product secured with one hand.

11. The package of claim 9, wherein, in response to an impact, such as due to dropping said container, the package is adapted to allow the curved product to move relative to said suspension pad if the stretch wrapping film elongates.

12. A package comprising:

a curved product having a concave back surface, a top surface, a bottom surface, a height, and a width, wherein said concave back surface has a periphery;

a suspension pad adapted for use with said curved product, said suspension pad comprising a front side, a rear side, a top edge, a bottom edge, a left edge, a right edge, a first notch extending inwardly from said bottom edge, a second notch extending inwardly from said bottom edge, a third notch extending inwardly from said top edge and a fourth notch extending inwardly from said top edge, wherein said suspension pad is taller than said height of said curved product, wherein a distance between said first and third notches is approximately equal to said height of said curved product, wherein said curved product is positioned on said front side of said suspension pad with said concave back surface contacting said front side; and a stretch wrapping film stretched around said curved product and said suspension pad and received in said first, second, third and fourth notches securing said curved product to said suspension pad and with said suspension pad bent in a planar curve shape that substantially conforms to said periphery of said concave back surface with substantially the entire periphery of said concave back surface of said curved product abutting said front side of said suspension pad and wherein an entirety of said top edge of said suspension pad is substantially free of bends or creases that would impair said top edge from curving when said suspension pad bends and forms a planar curve that substantially conforms to the concave back surface of said curved product.

13. The package of claim 12, wherein said top edge of said suspension pad defines a continuous curved shape that encompasses the entire top edge of said suspension pad when said curved product is secured on said suspension pad by said stretch wrapping film.

14. The package of claim 12, further comprising:

a container adapted specifically to hold said suspension pad bent in a planar curve with said curved product secured to said suspension pad with said stretch wrapping film, wherein said container and said suspension pad are constructed and arranged to suspend said curved product within said container such that no portion of said curved product contacts or is directly adjacent to said container.

15. The package of claim 14, wherein said container and said suspension pad are not fastened together such that said suspension pad with said curved product secured to said suspension pad can be inserted and removed from said container as an intact unit without damaging said container or said curved product or disassembling said container besides opening it.

16. The package of claim 14, wherein said container and said suspension pad are adapted to transport said suspension pad and said curved product in a vertical orientation.

17. The package of claim 16, wherein the package does not include any bracing or support elements positioned below the curved product and between the curved product and the container that would transmit force applied to said container to the curved product except for said suspension pad and said stretch wrapping film.

18. The package of claim 14, wherein said container is adapted to hold a single suspension pad with said curved product secured to said suspension pad.

19. The package of claim 12, wherein said suspension pad further comprises a centrally positioned hand hole positioned inside of the periphery of said concave back surface of said curved product when said curved product is secured to said suspension pad by said stretch wrapping film and wherein said hand hole is positioned to allow an individual to pick up and carry said suspension pad with said curved product secured to it with one hand.

20. The package of claim 13, wherein said stretch wrapping film covers an entire front surface of said curved product.

21. The package of claim 17, wherein, in response to an impact, such as due to dropping said container, the package is adapted to allow the curved product to move relative to said suspension pad if the stretch wrapping film elongates.

22. The package of claim 13, wherein said curved product is an automobile front windshield.

* * * * *

UNITED STATES PATENT AND TRADEMARK OFFICE

CERTIFICATE OF CORRECTION

PATENT NO. : 9,027,752 B2
APPLICATION NO. : 12/117376
DATED : May 12, 2015
INVENTOR(S) : Arch W. Carroll, Jr.

It is certified that error appears in the above-identified patent and that said Letters Patent is hereby corrected as shown below:

Specification

In column 1, line 9, please replace "2005" with --2003--.

In column 2, line 56 thru line 61, please delete the paragraph
"Referring now to Fig. 16, an alternate embodiment of the present disclosure is shown including curved windshield 18 mounted to pad 11 by film stretch wrapped around the pad and the windshield as at 19. The stretch wrapping is spread out over the whole width of windshield 18 and covers the entire perimeter of windshield 18.".

In column 3, after line 11, please add the paragraph
--Referring now to Fig. 16, an alternate embodiment of the present disclosure is shown including curved windshield 18 mounted to pad 11 by film stretch wrapped around the pad and the windshield as at 19. The stretch wrapping is spread out over the whole width of windshield 18 and covers the entire perimeter of windshield 18.--.

Signed and Sealed this
Seventeenth Day of November, 2015

Michelle K. Lee

Michelle K. Lee
*Director of the United States Patent and Trademark Office*